US007409894B1

(12) United States Patent
Valentine

(10) Patent No.: US 7,409,894 B1
(45) Date of Patent: Aug. 12, 2008

(54) HAMMER HEAD RATCHET DEVICE

(76) Inventor: Alice Valentine, 1240 Boca Ciega Isle Dr., St. Pete Beach, FL (US) 33706

( * ) Notice: Subject to any disclaimer, the term of this patent is extended or adjusted under 35 U.S.C. 154(b) by 0 days.

(21) Appl. No.: 11/829,227

(22) Filed: Jul. 27, 2007

(51) Int. Cl.
*B25B 13/46* (2006.01)
*B25B 15/04* (2006.01)
*B25F 1/04* (2006.01)
*B25G 1/08* (2006.01)

(52) U.S. Cl. ..... 81/63.1; 81/20; 81/177.4; 7/143; 7/165; 7/490

(58) Field of Classification Search ..... 81/62, 81/63.1, 20, 125, 177.4, 490; 7/138, 143, 7/146, 165
See application file for complete search history.

(56) References Cited

U.S. PATENT DOCUMENTS

| | | | | |
|---|---|---|---|---|
| 102,677 | A * | 5/1870 | Gregory | 81/20 |
| 1,109,507 | A * | 9/1914 | Bostock | 7/143 |
| D208,068 | S | 7/1967 | Rando | |
| 4,474,091 | A | 10/1984 | Russ | |
| 5,526,723 | A | 6/1996 | Sormunen et al. | |
| 5,606,758 | A | 3/1997 | Tung | |
| 5,970,552 | A | 10/1999 | Kwiecien et al. | |
| 6,047,802 | A | 4/2000 | Huang | |
| 6,276,014 | B1 * | 8/2001 | Lee | 7/165 |
| 6,279,876 | B1 | 8/2001 | Massie | |
| 6,502,485 | B1 | 1/2003 | Salazar | |
| 6,662,688 | B1 | 12/2003 | Avery | |
| 6,827,333 | B1 | 12/2004 | Lutz | |
| 6,845,694 | B2 * | 1/2005 | Ping | 81/177.4 |
| 6,922,864 | B2 | 8/2005 | Clarke et al. | |
| D521,825 | S | 5/2006 | Johnson | |
| 2004/0129119 | A1 | 7/2004 | Clarke et al. | |
| 2005/0229322 | A1 | 10/2005 | Chiu et al. | |
| 2006/0048305 | A1 * | 3/2006 | Giordano et al. | 7/143 |
| 2006/0075571 | A1 | 4/2006 | Lin | |
| 2006/0144195 | A1 | 7/2006 | Tanga | |

* cited by examiner

*Primary Examiner*—Hadi Shakeri
(74) *Attorney, Agent, or Firm*—Dennis G. LaPointe

(57) ABSTRACT

A hammer head ratchet device that includes a handle with a hammer head at one end, a ratchet driving mechanism assembly located at the bottom end of the handle for using a selected tool bit to perform a desired tool bit function, and slots or compartments to store tool bits for use with the device. The tool bits can be stored along the handle in one embodiment or pivotally attached near the bottom of the handle so as to rotate into a generally central location below the ratchet driver for use.

3 Claims, 8 Drawing Sheets

HAMMER HEAD RATCHET DEVICE

FIELD OF THE INVENTION

The invention relates to the field of hand held multi-functional tools having a ratchet driver at one end and a hammer head at the opposite end.

BACKGROUND OF THE INVENTION

The object of the invention is to provide a single multi-functional tool or device that incorporates into a hammer-like tool, a ratchet mechanism that allows for the selective manipulation and use of various tool bits associated with the device.

SUMMARY OF THE INVENTION

The invention is a hammer head ratchet device comprising a handle with a hammer head at a proximal end of the handle. It includes a ratchet driver means comprising a ratchet driving mechanism assembly for using a selected tool bit to perform a desired tool bit function. The ratchet driving mechanism is located proximate a distal end of the handle. The invention also includes means for selectively choosing one of two or more tool bits attached to the handle for use with the ratchet driving mechanism.

The ratchet driving mechanism can be made according to any of several ratchet devices available commercially. One example is that depicted as in U.S. Pat. No. 6,047,802 to Huang and which is fully incorporated by reference herein. It is understood that other ratchet mechanisms are contemplated for use with this invention.

In one embodiment, the means for selectively choosing anyone of two or more tool bits attached to the handle for use with the ratchet driving mechanism comprises a plurality of slots aligned with an axis of the handle. Each tool bit is pivotally attached in each of slot so as to be stored within the slot when not in use and rotated into a secured position so as to be aligned with a proximate central axis of the ratchet driving mechanism for using the selected tool bit. The pivotal attachment is accomplished by using a retainer pin through the handle and through a bottom arm of the tool bit.

This embodiment preferably includes tool bit release means for allowing the selected tool bit to be retracted from the slot for use. This is typically a lever that can be activated to unlock the tool bit from its storage slot so it can be released for pivotally rotating in place for use. Again, these simple release/locking mechanism are well known in the tooling trade and can be simple arm mechanisms or spring or spring/ball mechanisms. The tool bit release mechanism is typically held in place using a retainer pin through the bottom end of the handle.

The invention further includes means for selectively toggling said ratchet driving mechanism between a clockwise movement, a counter-clockwise movement, and a locked non-rotational position. Again, as in most ratchet devices known in the art and also described in U.S. Pat. No. 6,047,802 mentioned above, the ratchet outside adjustment ring is manipulated to typically three positions, one for generating a driving clockwise movement where a counter-clockwise movement is free-turning, the other for generating a counter-clockwise movement for backing-out fasteners where the clock-wise movement is free-turning and the third position for being a neutral locked position for driving and backing-out fasteners and there is no free-turning movement in either direction.

In another embodiment of the invention, the means for selectively choosing anyone of two or more tool bits attached to the handle for use with the ratchet driving mechanism comprises two or more radially spaced-apart tool bit storage slots generally aligned vertically along an outside perimeter of the handle at an intermediate portion thereof. The slots would have sufficient length and depth to snap the bit in place and the slotted area could optionally have a handle surface indented portion to further facilitate a person's finger tips grasping at least an end of the bit to remove the bit from the slotted storage compartment.

This embodiment further comprises means for attaching the selected tool bit to a bottom end of the distal end of the handle so as to be generally aligned with a central axis of the ratchet driving mechanism for using the selected tool bit. In this embodiment, the means for attaching the selected tool bit comprises a tool bit attachment receptor having means for holding the selected tool bit in place. Such methods of holding a tool bit in place are known in the art. Examples range from a simple polygonal shaped receptor in which the tool bit is snugly held in place frictionally. Another is a ball/spring mechanism in which the bit is snapped into position and the ball/spring mechanism holds the bit in place. Still another is the use of a magnet insert placed and held within the receptor void and in which the bit is magnetically held in place for use.

DETAILED DESCRIPTION OF THE INVENTION

Figure 1:
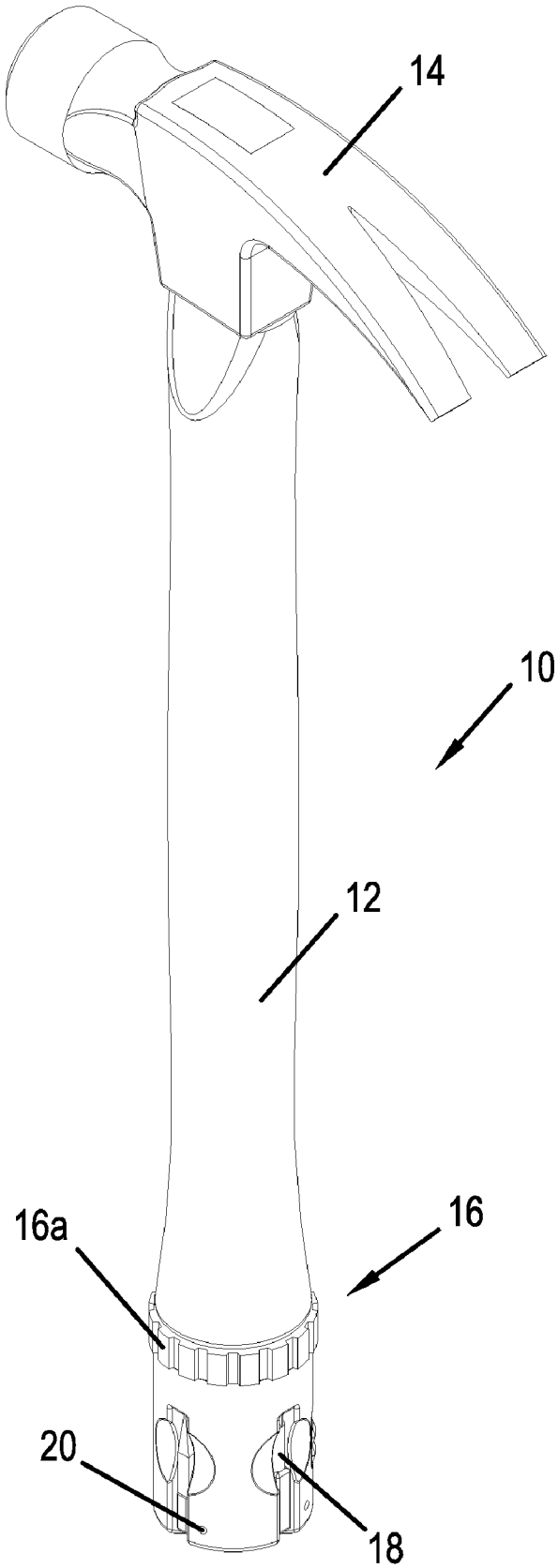
FIG. 1 is a perspective view of an example of one embodiment of the invention.
Figure 2:
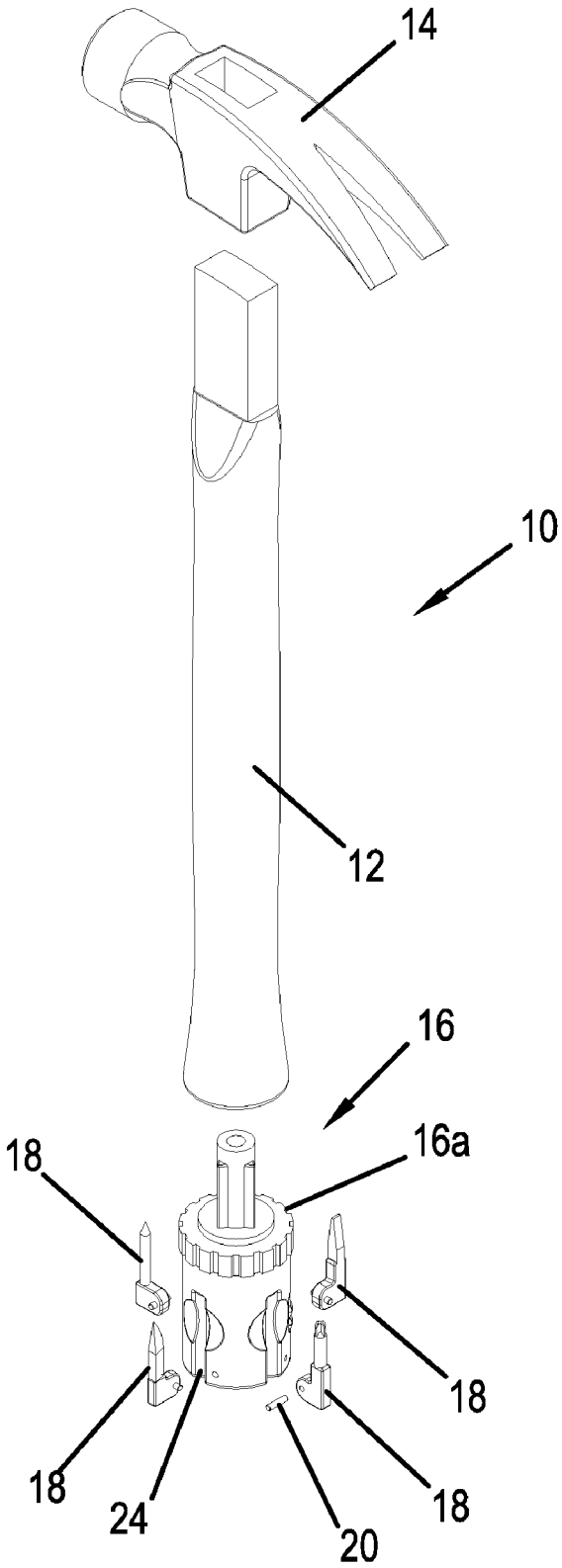
FIG. 2 is an exploded view of the example depicted in FIG. 1.
Figure 3A:
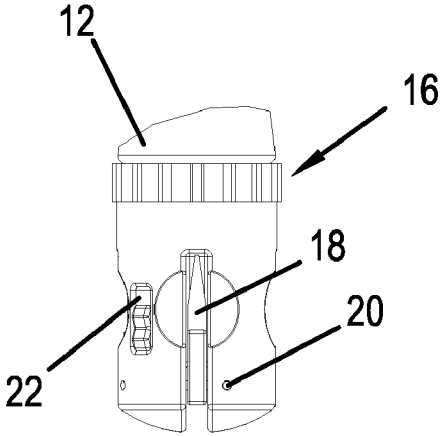
FIG. 3*a* is a side view of a bottom end of the embodiment of FIG. 1.
Figure 3B:
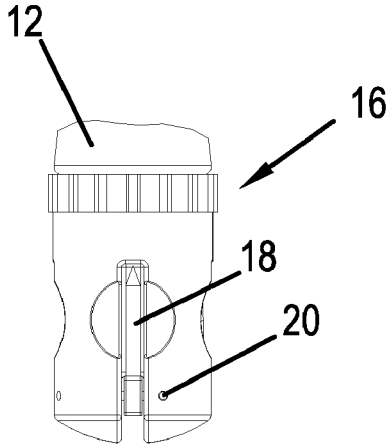
FIG. 3*b* is another side view of a bottom end of the embodiment of FIG. 1, rotated 90 degrees from the view depicted in FIG. 3*a;*
Figure 3C:
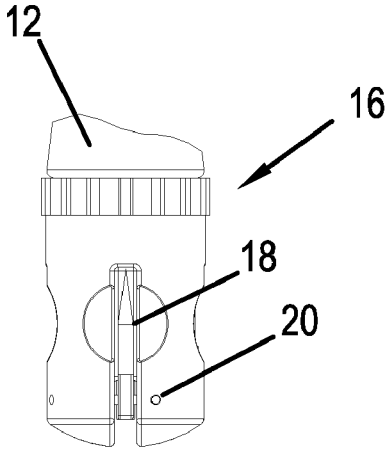
FIG. 3*c* is another side view of a bottom end of the embodiment of FIG. 1, rotated 90 degrees from the view depicted in FIG. 3*b;*
Figure 3D:
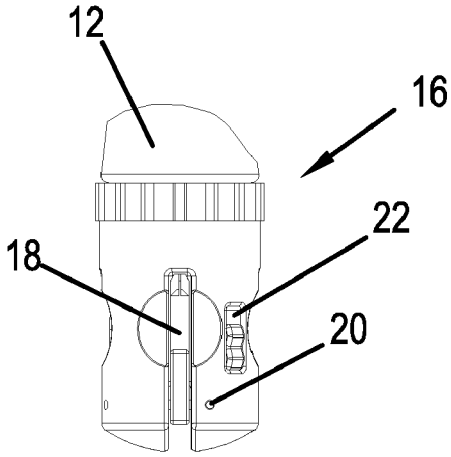
FIG. 3*d* is another side view of a bottom end of the embodiment of FIG. 1, rotated 90 degrees from the view depicted in FIG. 3*c;*
Figure 3E:
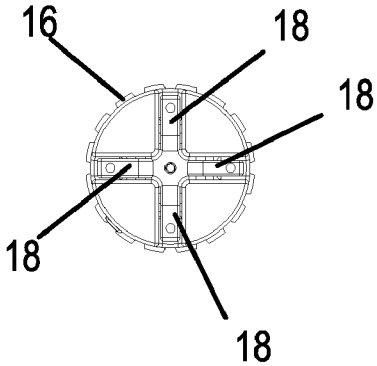
FIG. 3*e* is a bottom end view of the lower end of the invention depicted in FIG. 1.
Figure 4A:
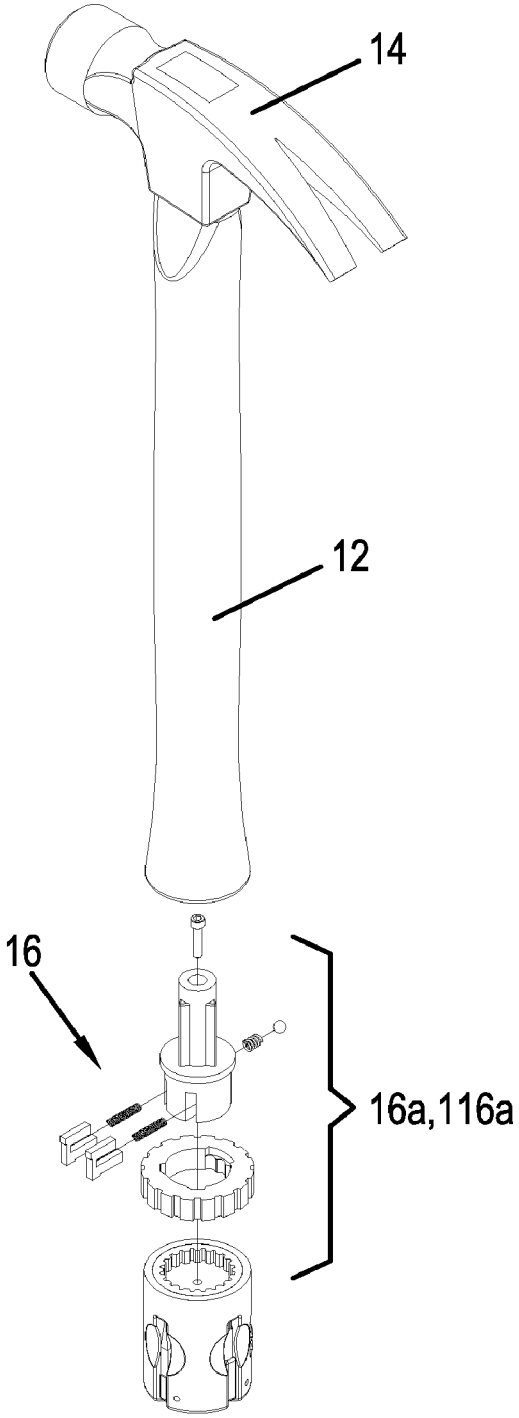
FIG. 4*a* is a perspective view if the embodiment of FIG. 1 with a partial exploded view of an example of a ratchet mechanism and its components.
Figure 4B:
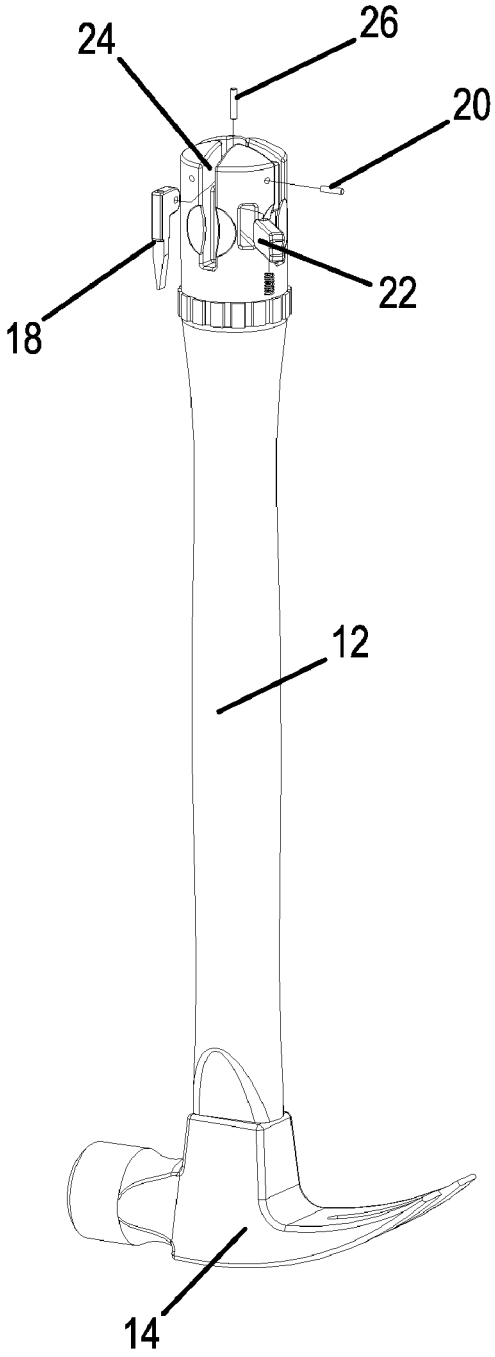
FIG. 4*b* is a perspective depiction of the invention with a partial exploded view of the tool ratchet assembly end.
Figure 5:
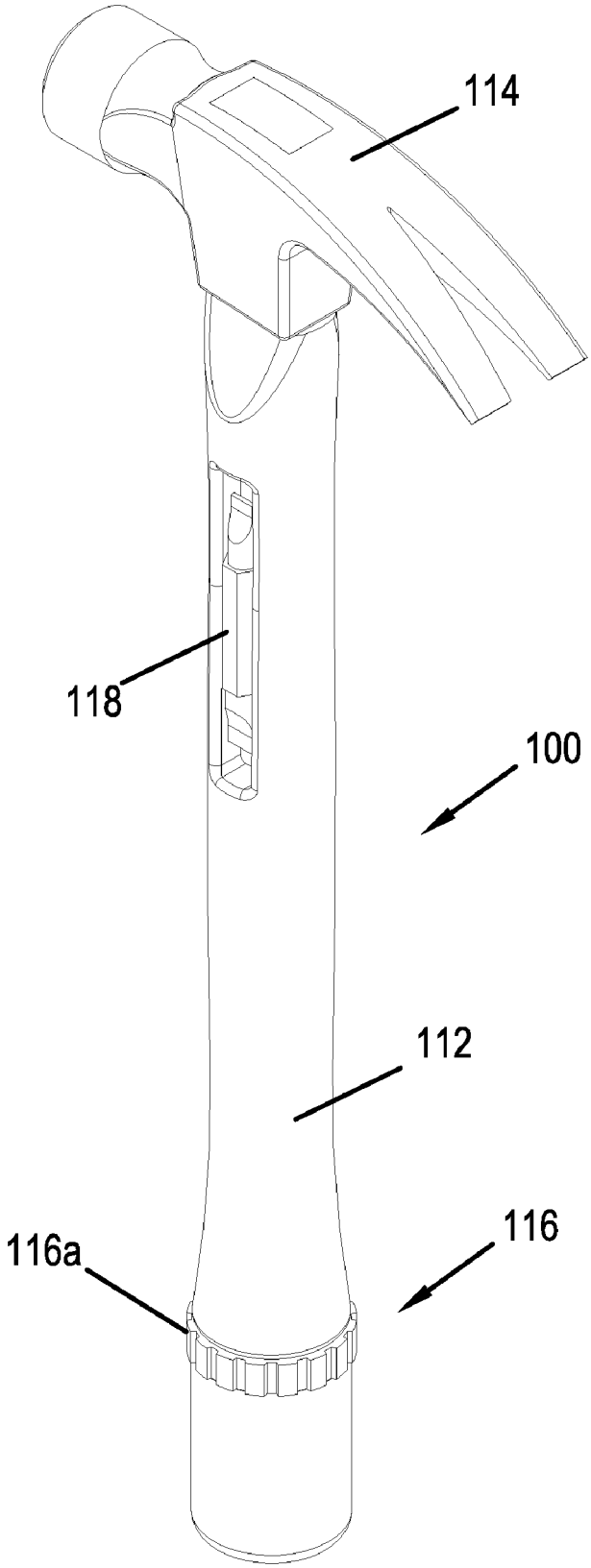
FIG. 5 is a perspective view of an example of another embodiment of the invention.
Figure 6:
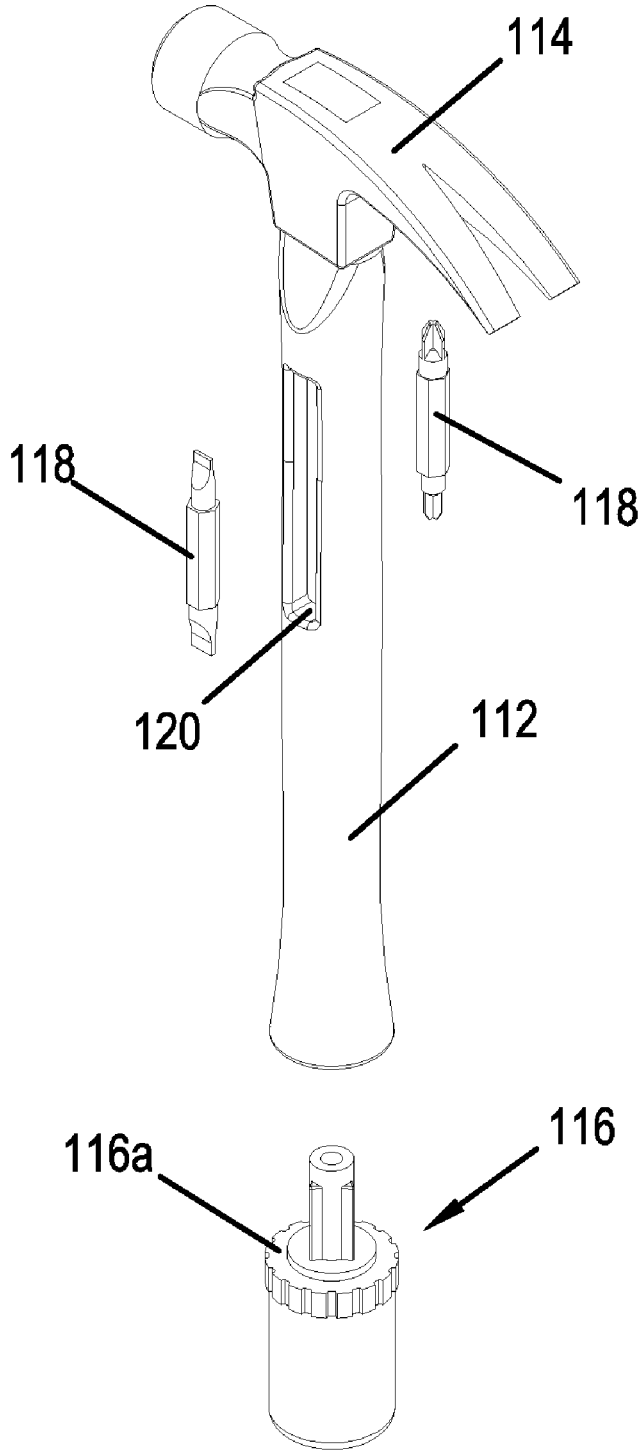
FIG. 6 is a an exploded view of the example depicted in FIG. 5.
Figure 7A:
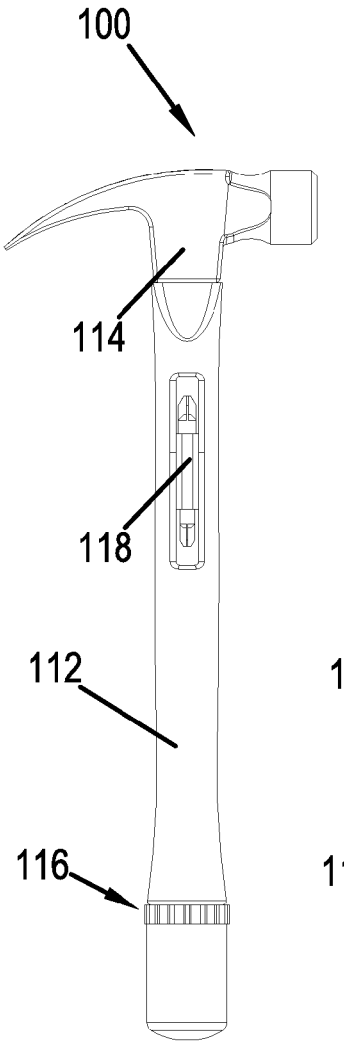
FIG. 7*a* is a side view of the embodiment of FIG. 5.
Figure 7B:
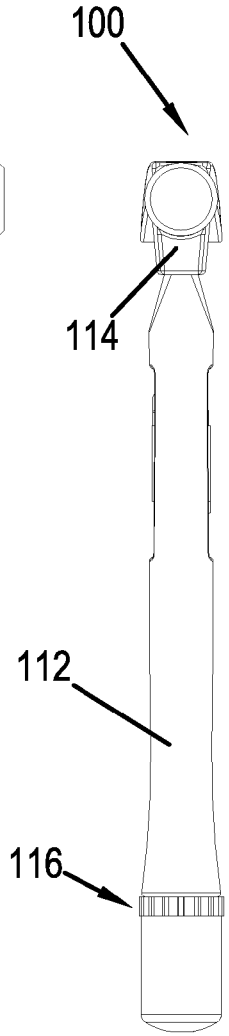
FIG. 7*b* is another side view of the embodiment of FIG. 5, rotated 90 degrees from the view depicted in FIG. 7*a;*
Figure 7C:
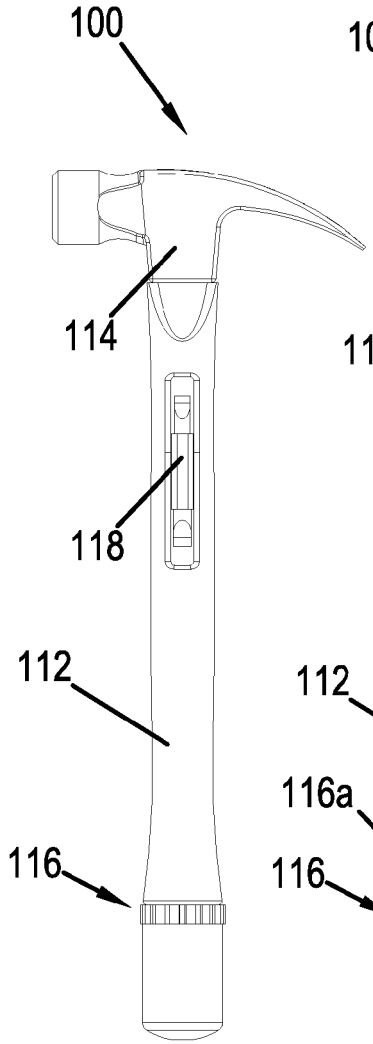
FIG. 7*c* is another side view of the embodiment of FIG. 5, rotated 90 degrees from the view depicted in FIG. 7*b;*
Figure 7D:
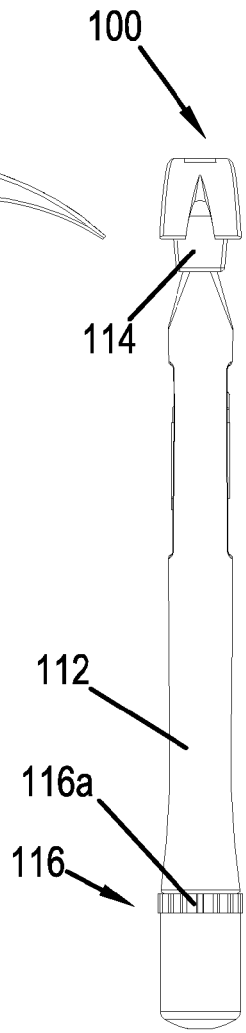
FIG. 7*d* is another side view of the embodiment of FIG. 5, rotated 90 degrees from the view depicted in FIG. 7*c;*
Figure 7E:
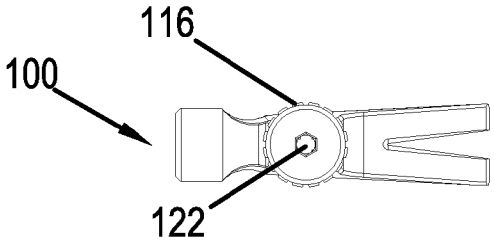
FIG. 7*e* is a bottom end view of the lower end of the invention depicted in FIG. 5.
Figure 8A:
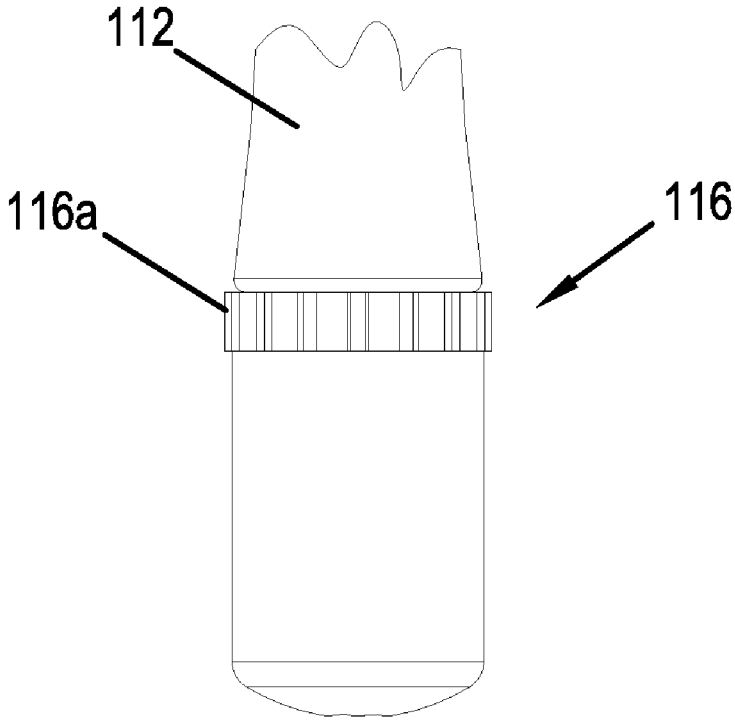
FIG. 8*a* is a side view of the bottom end of the embodiment of FIG. 5.
Figure 8B:
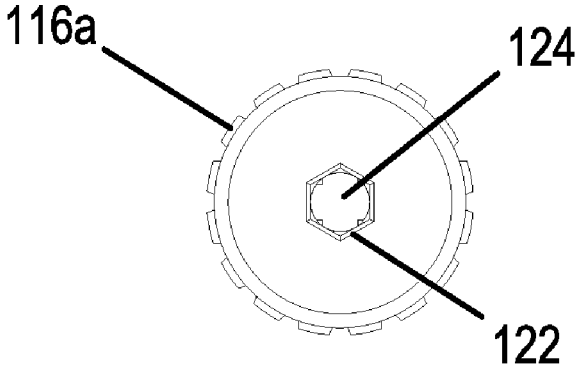
FIG. 8*b* is a bottom end view of FIG. 8*a.*

Referring now to the drawings, the invention is depicted generally by way of example only, as two embodiments, one depicted as 10, FIGS. 1, 2, 3*a*-3*e* and 4*a*-4*b*, and the other as 100, FIGS. 5, 6, 7*a*-7*e* and 8*a*-8*b*.

The invention is accordingly a hammer head ratchet device 10, 100 comprising a handle 12, 112 with a hammer head 14, 114 at a proximal end of the handle 12, 112. It includes ratchet driver means comprising a ratchet driving mechanism assembly 16, 116 for using a selected tool bit 18, 118 to perform a desired tool bit function. The ratchet driving mechanism 16, 116 is located proximate a distal end of the handle 12, 112. The invention also includes means for selectively choosing one of two or more tool bits 18, 118 attached to the handle 12, 112 for use with the ratchet driving mechanism 16, 116. Hammer head 14, 114 is, as shown in the drawings, a conventional nail claw and impact head combination forming a conventional T-shaped hammer 14, 114 and handle 12, 112 combination. The T-shaped portion or nail claw/impact head forming the hammer head 14, 114 is perpendicular to a central axis of the handle 12, 112 and this configuration facilitates the easy rotating of the handle 12, 112 when using the ratchet portion of the invention.

In each embodiment, the ratchet driving mechanism 16, 116 can be made according to any of several ratchet devices available commercially. One example is that depicted as 16, 116 in the drawings, particularly the exploded view shown in FIG. 4*a* wherein the assembly 16 shown is that depicted as assembly 116 in drawings related to the second embodiment described herein. The ratchet gears and spring and ball parts shown are fully described and disclosed in U.S. Pat. No. 6,047,802 to Huang and which is fully incorporated by reference herein. It is understood that other ratchet mechanisms are contemplated for use with this invention.

The hammer head and handle may be made from material suitable for such anticipated function known in the art, such as alloy steels for the hammer heads and handles, composite fiberglass and polymer based material handles, wooden handles, etc.

Tool bits 18, 118 may those typically associated with such ratcheting devices including screwdriver bits including Phillips and flat head bits and Torx bits, among others, socket drivers, Allen wrench hex tool bits, square bits, etc., that is, any combination of these typical tool bits 18, 118 may be incorporated into the various embodiments described herein. It is anticipated that at least two tool bits 18, 118 would be incorporated in the invention with the typical number of tool bits 18, 118 being incorporated being four to six bits 18, 118.

In the first embodiment, the means for selectively choosing anyone of two or more tool bits 18 attached to the handle 12 for use with the ratchet driving mechanism 16 comprises a plurality of slots 24 aligned with an axis of the handle 12. Each tool bit 18 is pivotally attached in each of slot 24 so as to be stored within the slot when not in use and rotated into a secured position so as to be aligned with a proximate central axis of the ratchet driving mechanism 16 for using the selected tool bit 18. The pivotal attachment is accomplished by using a retainer pin 20 through the handle 12 and through a bottom arm of the tool bit 18 as shown in FIGS. 2 and 3*a*-3*e*.

The device shown in FIGS. 1-4 also preferably includes tool bit release means 22 for allowing the selected tool bit to be retracted from the slot for use. This is typically a lever that can be activated to unlock the tool bit 18 from its storage slot 24 so it can be released for pivotally rotating in place for use. Again, these simple release/locking mechanism are well known in the tooling trade and can be simple arm mechanisms or spring or spring/ball mechanisms. The tool bit release mechanism 22 is typically held in place using a retainer pin 26 as shown in FIG. 4*b* through the bottom end of the handle 12.

Either embodiment shown in FIGS. 1-8 further include means 16*a*, 116*a* for selectively toggling said ratchet driving mechanism between a clockwise movement, a counter-clockwise movement, and a locked non-rotational position. Again, as in most ratchet devices known in the art and also described in U.S. Pat. No. 6,047,802 mentioned above, the ratchet outside adjustment ring (shown as 16*a*, 116*a* herein) is manipulated to typically three positions, one for generating a driving clockwise movement where a counter-clockwise movement is free-turning, the other for generating a counter-clockwise movement for backing-out fasteners where the clock-wise movement is free-turning and the third position for being a neutral locked position for driving and backing-out fasteners and there is no free-turning movement in either direction.

In the embodiment shown in FIGS. 5-8, the means for selectively choosing anyone of two or more tool bits 118 attached to the handle 112 for use with the ratchet driving mechanism 116 comprises two or more radially spaced-apart tool bit storage slots 120 generally aligned vertically along an outside perimeter of the handle 112 at an intermediate portion thereof. As shown in the example depicted in the drawings, the slots 120 would have sufficient length and depth to snap the bit 118 in place and the slotted area could optionally have a handle surface indented portion to further facilitate a person's finger tips grasping at least an end of the bit 118 to remove the bit 118 from the slotted storage compartment 120.

This embodiment further comprises means for attaching the selected tool bit to a bottom end of the distal end of the handle 112 so as to be generally aligned with a central axis of the ratchet driving mechanism 116 for using the selected tool bit 118. In the example depicted, the means for attaching the selected tool bit 118 comprises a tool bit attachment receptor 122 having means for holding the selected tool bit in place. Such methods of holding a tool bit in place are known in the art. Examples range from a simple polygonal shaped receptor in which the tool bit in snugly held in place frictionally. Another is a ball/spring mechanism in which the bit is snapped into position and the ball/spring mechanism holds the bit in place. Still another is the use of a magnet insert 124 placed and held within the receptor void 122 and in which the bit 118 is magnetically held in place for use.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A hammer head ratchet device comprising:

a handle with a hammer head at a proximal end of said handle, said hammer head being formed as a conventional generally T-shaped claw and impact head combination hammer head;

ratchet driver means comprising a ratchet driving mechanism assembly for using a selected tool bit to perform a desired tool bit function;

said ratchet driving mechanism being located proximate a distal end of said handle; and means for selectively choosing one of two or more tool bits attached to said handle for use with said ratchet driving mechanism, said means for selectively choosing said one of two or more tool bits comprising a plurality of slots aligned with an axis of said handle around an outside periphery of said handle below said ratchet driving mechanism, wherein each of said two or more tool bits are pivotally attached in each of said slots so as to be stored within said slots when not in use and rotatable into a secured position with said ratchet driving mechanism so as to be aligned with a proximate central axis of said ratchet driving mechanism when in use, and wherein said pivotal attachment is accomplished by using a retainer pin through the handle and through a respective bottom arm of said tool bits.

2. The device according to claim 1, further comprising: tool bit release means for allowing said selected tool bit to be retracted from said slot for use.

3. The device according to claim 1, further comprising: means for selectively toggling said ratchet driving mechanism between a clockwise movement, a counter-clockwise movement, and a locked non-rotational position.

* * * * *